US008894459B2

(12) United States Patent
Leyland et al.

(10) Patent No.: US 8,894,459 B2
(45) Date of Patent: Nov. 25, 2014

(54) DEVICES AND METHODS FOR PAIRING INDUCTIVELY-COUPLED DEVICES

(71) Applicants: Robert Leyland, Novato, CA (US); John Reine, Novato, CA (US)

(72) Inventors: Robert Leyland, Novato, CA (US); John Reine, Novato, CA (US)

(73) Assignee: Activision Publishing, Inc., Santa Monica, CA (US)

( * ) Notice: Subject to any disclaimer, the term of this patent is extended or adjusted under 35 U.S.C. 154(b) by 148 days.

(21) Appl. No.: 13/831,340

(22) Filed: Mar. 14, 2013

(65) Prior Publication Data

US 2014/0273714 A1 Sep. 18, 2014

(51) Int. Cl.

| | |
|---|---|
| ***A63H 33/26*** | (2006.01) |
| ***H01F 7/02*** | (2006.01) |
| *A63H 3/16* | (2006.01) |

(52) U.S. Cl.

CPC ..... *H01F 7/0263* (2013.01); *A63H 33/26* (2013.01)

USPC ..... 446/92; 446/139

(58) Field of Classification Search

USPC ..... 446/92, 129, 131–139

See application file for complete search history.

(56) References Cited

U.S. PATENT DOCUMENTS

| | | | | |
|---|---|---|---|---|
| 4,486,729 | A * | 12/1984 | Lee | 335/306 |
| 5,746,638 | A | 5/1998 | Shiraishi | |
| 6,290,565 | B1 | 9/2001 | Galyean, III et al. | |
| 6,705,794 | B2 | 3/2004 | Varner et al. | |
| 6,722,941 | B2 | 4/2004 | Dowd et al. | |
| 6,773,322 | B2 | 8/2004 | Gabai et al. | |
| 6,893,315 | B2 | 5/2005 | Barri | |
| 7,144,179 | B2 | 12/2006 | Varner et al. | |
| 7,325,996 | B2 | 2/2008 | Varner et al. | |
| 7,520,793 | B2 | 4/2009 | Pillai et al. | |
| 7,963,818 | B2 | 6/2011 | Fullerton et al. | |
| 8,079,890 | B2 | 12/2011 | Seligman | |
| 8,127,408 | B2 | 3/2012 | Wiseman | |
| 2007/0141860 | A1 | 6/2007 | Hernandez et al. | |
| 2008/0204181 | A1 | 8/2008 | Tolle et al. | |
| 2010/0022158 | A1 * | 1/2010 | Kim | 446/92 |
| 2010/0156345 | A1 | 6/2010 | Phelps, III | |
| 2010/0181841 | A1 | 7/2010 | Azancot et al. | |
| 2011/0234154 | A1 | 9/2011 | Navid | |
| 2011/0304220 | A1 | 12/2011 | Whitehead | |
| 2012/0181876 | A1 | 7/2012 | Baarman et al. | |

* cited by examiner

*Primary Examiner* — Kien Nguyen

(74) *Attorney, Agent, or Firm* — Klein, O'Neill & Singh, LLP

(57) ABSTRACT

A first device may be paired to a second device, with the first and second devices including inductive elements, the devices may be paired by aligning a first magnetic element of a first device and a second magnetic element of a second device. At least one additional magnetic element is used to redirect magnetic fields generated by the first magnetic element and the second magnetic element away from the inductive elements.

7 Claims, 7 Drawing Sheets

DEVICES AND METHODS FOR PAIRING INDUCTIVELY-COUPLED DEVICES

BACKGROUND

The present invention relates generally to physical pairing of inductively coupled devices, and more particularly to physical pairing of inductively coupled devices having magnets.

The use of wireless devices has proliferated in recent years. Not only can devices wirelessly transmit data to other devices, devices can also wirelessly supply power to other devices.

There are many applications that utilize the wireless transmission of data. One particular category of applications involves short-range or near-field transmissions, which typically occur over a distance of several feet or less. Examples of short-range or near-field transmission protocols or standards include radio-frequency identification (RFID), dedicated short-range communications (DSRC), Bluetooth, ZigBee, and near-field communications (NFC).

There are also many applications for utilizing wireless power supplies. For example, passive RFID tags may be wirelessly charged by active RFID devices and passive NFC tags may be wirelessly charged by active NFC devices. Likewise, a variety of electrical or electronic devices, including electric cars, electric toothbrushes, mobile phones, mp3 players, and the like, may be wirelessly charged using wireless charging pads, plates, stations, or other charging devices.

Electromagnetic induction may be used for wirelessly transmitting data or wirelessly supplying power from one device to another device. Typically, a first device that uses electromagnetic induction to transmit data or supply power to a second device includes a first inductive element, often a primary coil. When electric current flows through the first device's primary coil, an electromagnetic field is created. If the first device's primary coil is in proximity to a secondary coil in the second device, the primary coil's electromagnetic field may inductively couple with the second device's secondary coil, producing a current within the secondary coil. This current may be used in transmission of data or supply of power between the two devices.

For the inductive coupling to achieve high efficiency, it is typically desirable to properly align the primary coil and the secondary coil and minimize the distance between the primary coil and the secondary coil. To promote the proper alignment of, and distance between, two inductively coupled devices, the two inductively coupled devices may be physically and/or mechanically paired using, for example, magnets, gravity, groves, guides, slots, clamps, latches, cradles, or other well-known pairing techniques.

The use of magnets to pair two inductively coupled devices, however, may be problematic. A magnetic field is associated with the magnets, and an electromagnetic field is associated with the inductively coupled devices in operation. In addition, the inductive devices may themselves be magnetizable, and the magnets themselves may include material that is responsive in some way to electromagnetic field states. The magnetic field and the electromagnetic field may interfere with one another, possibly degrading performance. The magnetic field may also affect the inductive devices in such a way that degrades operation of the inductive coupling. The electromagnetic field may also affect the magnets (or their materials) in varying ways.

Widely separating in distance the inductive elements and the magnets may avoid or reduce these variations interactions. However, such a wide separation may be difficult to obtain if the devices are not physically large.

SUMMARY OF THE INVENTION

One aspect of the present invention provides an apparatus for pairing a first device to a second device, the first device comprising a first inductive element and a first magnetic element, the second device comprising a second inductive element and a second magnetic element, wherein the first inductive element is inductively coupled to the second inductive element, wherein the first device is paired to the second device by aligning the first magnetic element and the second magnetic element such that they are opposing each other, and wherein at least one additional magnetic element is used to, either or both, redirect magnetic fields generated by the first magnetic element and the second magnetic element away from the inductive elements or reduce the level of magnetic fields generated by the first magnetic element and the second magnetic element in the inductive elements.

In another aspect of the present invention, the portion of the first magnetic element aligned with the second magnetic element has an opposite polarity to the portion of the second magnetic element opposing the first magnetic element, and the at least one additional magnetic element consists of a third magnetic element in the first device and a fourth magnetic element in the second device.

In another aspect of the invention, an apparatus including pairable devices, comprises: a first device comprising a first inductive element and a first magnetic element; a second device comprising a second inductive element and a second magnetic element, the first device being paired to the second device when the first magnetic element and the second magnetic element are aligned such that they are opposing each other, the first inductive element and the second inductive element being positioned to allow for inductive coupling when the first device is paired to the second device; and at least one additional magnetic element positioned to redirect magnetic fields generated by the first magnetic element and the second magnetic element away from the inductive elements when the first device is paired to the second device.

In another aspect of the present invention, a toy including inductively coupleable parts, comprises: a first part including a first inductive element, a first magnet, and a second magnet positioned proximate a first surface of the first device, the first magnet and the second magnet positioned so as to have anti-parallel magnetic dipole moments, the first inductive element having an inductance less than 100 micro-Henrys; and a second part including a second inductive element, a third magnet, and a fourth magnet positioned proximate a surface of the first device, the third magnet and the fourth magnet positioned so as to have anti-parallel magnetic dipole moments, the second inductive element having an inductance less than 100 micro-Henrys; the first inductive element, the first magnet, and the second magnet having a relative spacing to one another that is the same as relative spacing of the second inductive element, the third magnet and the fourth magnet, with spacing between the first inductive element and either of the first magnet or the second magnet being less than 10 mm.

In another aspect of the present invention, the first device supplies power to the second device through the inductive coupling.

In another aspect of the present invention, data is transmitted between the first device and the second device through the inductive coupling.

In another aspect of the present invention, the first inductive element and the second inductive element comprise ferrous material.

In another aspect of the present invention, the first inductive element, first magnetic element, and third magnetic element are arranged in a triangular formation within the first device.

DETAILED DESCRIPTION

Figure 1:
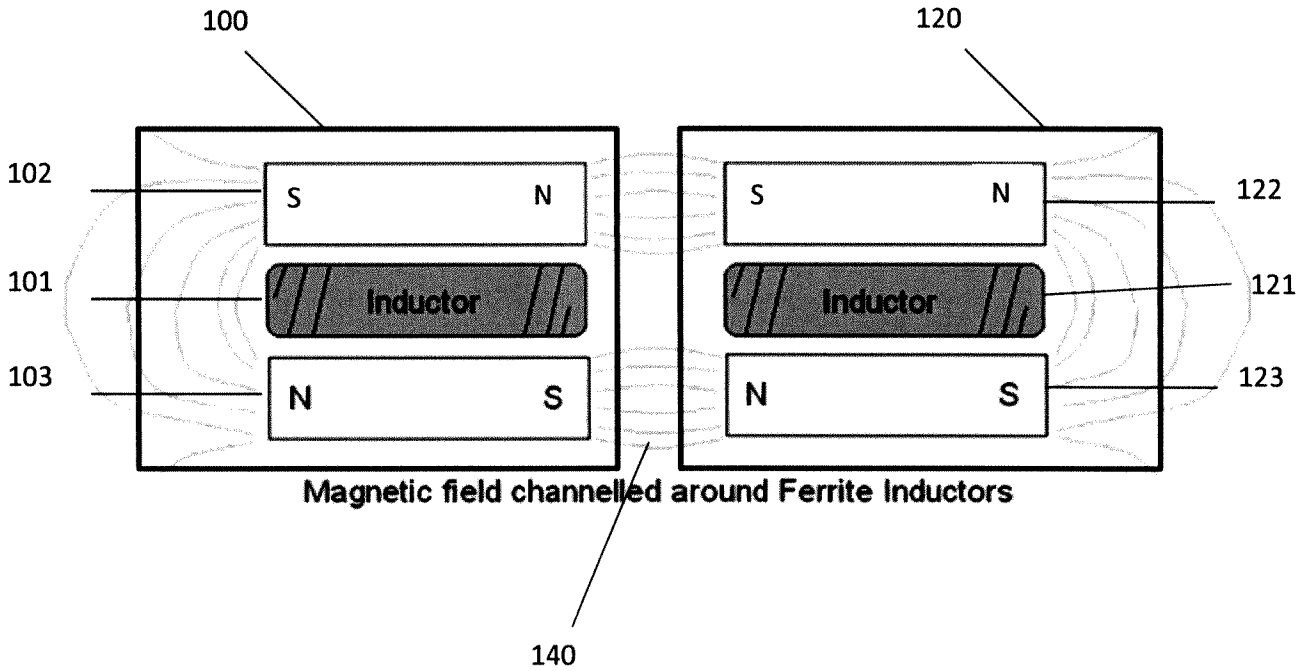
FIG. 1 illustrates an example of an apparatus for magnetically pairing two inductively coupled devices in accordance with aspects of the present invention.

An embodiment of an apparatus including a pairable first device and second device incorporating magnetic elements in accordance with the present invention is shown in the block diagram of FIG. 1. In FIG. 1, a first device 100 comprises an inductive element 101, which may be a primary coil. Inductive element 101 may receive an electric current, for example from power supply circuitry (not shown), which causes the inductive element 101 to generate an electromagnetic field (not shown). A second device 120 also comprises an inductive element 121, which may be a secondary coil. When the first device's inductive element 101 and the second device's inductive element 121 are proximal, positioned to allow for inductive coupling, and at least one of the inductive devices is powered, for example the first device's inductive device, an inductive coupling is formed. Through this inductive coupling, data and/or power may be transmitted from one of the devices to the other.

The first and second device also include magnet elements to facilitate pairing of the devices, with the first device 100 including a first magnetic element 102 and second magnetic element 103, and the second device includes a third magnetic element 127 and a fourth magnetic element 123. In accordance with aspects of the invention, the magnetic elements of the first device and second device are arranged such that when the first device and the second device are placed in proximity to one another, the magnets of the two devices may provide attractive forces which facilitate pairing of the devices. In most embodiments, the inductive element 101, the first magnetic element, and the second magnetic elements are within a housing of the first device, a housing that in some embodiments may be substantially solid. Also in most embodiments the inductive element 101 and the first and second magnetic elements are about a side of the housing, for example a top of the housing. As with the first device, in most embodiments the inductive element 121, the third magnetic element, and the fourth magnetic element are within a housing of the second device, a housing that in some embodiments may be substantially solid. Also in most embodiments, the inductive element 121 and the third and fourth magnets are about a side of the housing, for example a bottom of the housing. Preferably, and as for example illustrated in FIG. 1, the relative spacing between the first and second magnetic elements is the same as the relative spacing between the second and third magnetic elements, with the common relative spacing promoting pairing of the devices.

In the embodiment of FIG. 1, the first magnetic element and second magnetic element are positioned in the first device to have magnetic dipole moment vectors that are anti-parallel (in opposing directions), with in some embodiments the magnetic dipole moments being of equal magnitude. The third magnetic element and the fourth magnetic element are also positioned in the second device to have magnetic dipole moment vectors that are anti-parallel, with in some embodiments the magnetic dipole moments being of equal magnitude. Accordingly, the magnetic elements of the first device may be considered to be arranged in parallel but having opposite polarities, and the magnetic elements of the second device may also be considered to be arranged in parallel but having opposite polarities.

In the embodiment of FIG. 1 the magnetic elements are positioned such that, when the first and second devices are paired the magnetic dipole moments are aligned and in the same direction for corresponding magnetic elements of the first and second devices. Thus, in FIG. 1, the magnetic elements are positioned such that, when their inductive elements are positioned for inductive coupling, the first and third magnetic elements correspond, the second and fourth magnetic elements correspond, and the first magnetic element 102 is aligned with the third magnetic element 122 and the second magnetic element 103 is aligned with the fourth magnetic element 123.

With the first device and the second device paired, magnetic fields of the opposing pairs of magnetic elements, represented by magnetic field lines 140, are redirected and channeled together. This arrangement of magnetic elements 102, 103, 122, 123 as shown in the embodiment of FIG. 1 redirects the magnetic fields 140 of the magnetic elements 102, 103, 122, 123 away from the inductive elements 101 and 121, thereby reducing the amount of electromagnetic interference with, and improving the efficiency of, the inductive coupling.

The present invention for pairing inductively coupled devices is suitable for use with essentially any form of inductive coupling. The inductive elements described in the embodiment illustrated in FIG. 1 may be circular air core wire coils capable of generating and/or receiving an electromagnetic field. However, depending on the application, the inductive elements may alternatively be of any structure capable of generating and/or receiving a suitable electromagnetic field including, for example, ferrite core inductive elements, ferromagnetic core inductive elements, inductive elements with honeycomb or spider web coils, laminated core inductive elements, and/or a PCB coil. Accordingly, the particular inductive coupling method disclosed herein is merely exemplary. Other examples of inductive couplings include those disclosed in U.S. Pat. No. 5,070,293, entitled "Electric Power Transmitting Device With Inductive Coupling" and issued Dec. 3, 1991, to Ishii et al., U.S. Pat. No. 5,325,046, entitled "Inductive Wireless Data Connection" and issued Jun. 28, 1994, to Young et al., and U.S. Pat. No. 4,697,183, entitled "Means For Non-Contacting Signal And Energy Transmission" and issued Sep. 29, 1987, to Jenning et al.—all of which are incorporated herein by reference in their entirety.

It is believed that the arrangement of FIG. 1 is particularly suitable for high frequency or low power operation of the inductive coupling, more particularly for high frequency and low power operation of the inductive coupling, and even more particularly for either such operation when device constraints require relative close position of the magnetic elements to the inductive elements. For example, in some embodiments operation of the inductive coupling is performed at frequencies greater than 1 MHz, in some embodiments at frequencies about 10 MHz (for example 13 MHz), and in some embodiments above 10 MHz. In various embodiments the inductive elements may have an inductance less than 100 μH, and in some embodiments may have an inductance less than 20 μH, and in some embodiments may have an inductance less than 10 μH. In various such embodiments the magnetic elements may be positioned within 20 mm of the inductive elements, in some embodiments within 10 mm of the inductive elements, and in some embodiments within 5 mm of the inductive elements. In some embodiments the magnetic elements may have an energy product about 42 megagauss oersteds, and in some embodiments the magnetic element may be magnets, for example, a grade N42 neodymium magnet.

In addition, the arrangement of FIG. 1 is suitable for reducing the adverse effects of hysteresis losses on the efficiency of the inductive elements. More specifically, transfoimers couple energy from one coil to the other via an expanding and collapsing magnetic field. Efficiency is lost through the hysteresis of the core material, as it changes polarity. While modern materials may be designed to minimize these losses, a fixed magnetic field near the core greatly magnifies the hysteresis effect. By arranging the magnets so that the static magnetic field is channeled around the core material in accordance with aspects of the invention, the adverse effect of hysteresis losses may be reduced.

Aspects of the invention for magnetically pairing two inductively coupled devices may be used in a variety of applications. The following embodiments are meant to illustrate applications suitable for the present invention, and are by no means limiting.

Figure 2:
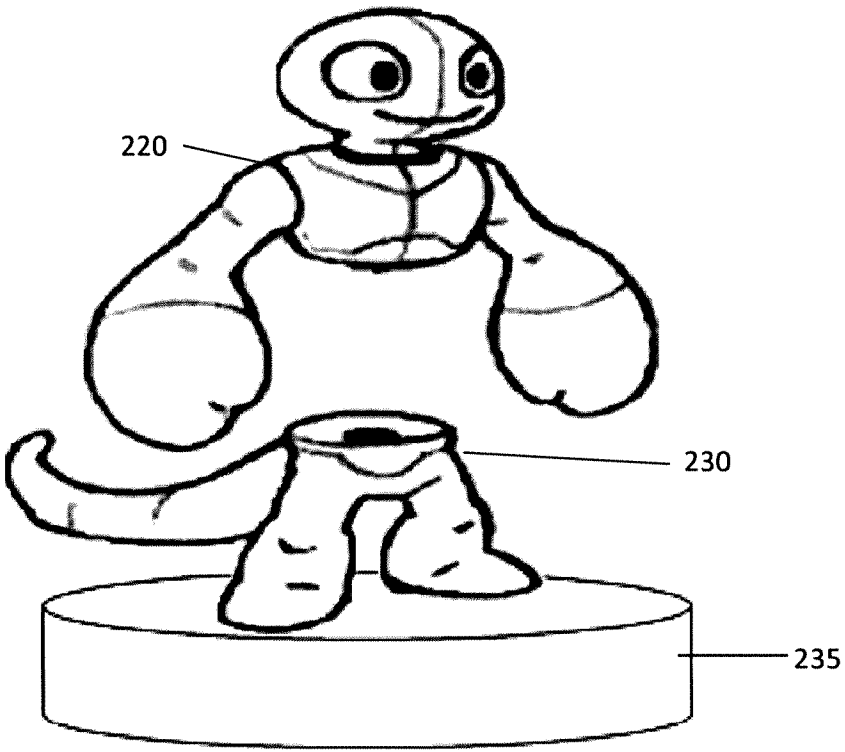
FIG. 2 illustrates an example of an inductively coupled toy assembly in accordance with aspects of the present invention.

FIG. 2 illustrates an embodiment of the present invention whereby the pairing apparatus is used to pair inductively coupled parts of a toy assembly 200. The toy assembly 200 of FIG. 2 includes two component toy parts: a top formed of a torso 220, and a bottom formed of legs 230 on a base 235. Although two toy parts are shown, the number and type of toy parts are exemplary only and should not be considered as limiting. The toy parts may be physically combined, coupled, connected or otherwise adjoined to create a toy assembly. In the present embodiment, the toy parts may be coupled in an interlocked fashion to create a toy assembly, for example via an electromagnetic mechanism, for example as discussed with respect to FIG. 1.

Each of the toy parts may include certain electronic components such as a storage components (e.g., memory or rewritable RFID tags), lighting components (e.g. LEDs), and/or audio components (e.g., audio output devices). However, it may be impractical or otherwise undesirable to include active power supplies in each of the toy parts. Accordingly, one toy part, for example the legs 230, may include an active power supply that can be used to inductively power the electronic components of the torso. In addition, it may be desirable for the two toy parts to communicate with each other, for example to transfer identification information stored in respective storage components. Accordingly, the two toy parts may also transfer data wirelessly over the inductive coupling.

Figure 3:
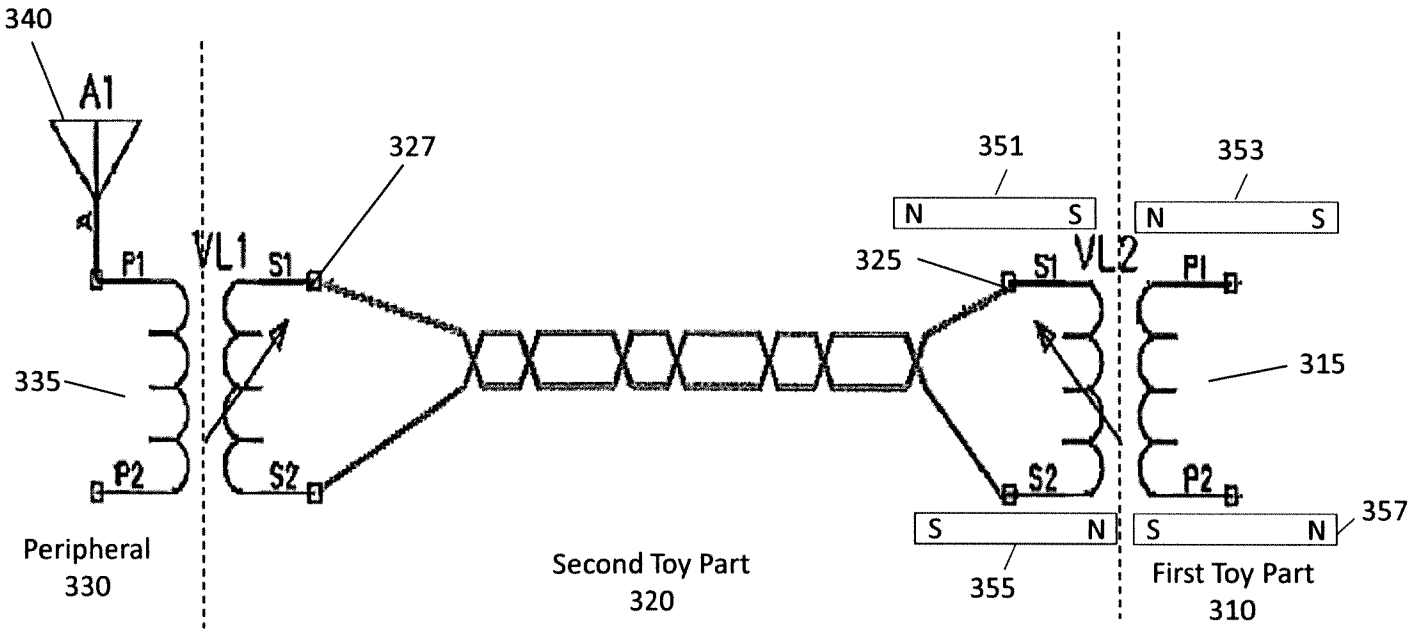
FIG. 3 illustrates an example of components of an inductively coupled toy assembly in accordance with aspects of the present invention.

FIG. 3 is a diagram depicting at least some electrical and magnetic components of a toy assembly, for example the toy of FIG. 2, proximate a peripheral reader in accordance with aspects of the invention. A first toy part 310, for example the torso 220 of FIG. 2, includes an inductive element 315. The inductive element 315 may be part of an RFID tag that uses radio-frequency electromagnetic fields to transfer data from (and in various embodiments to) the tag, for example for purposes of automatic identification and tracking. Some tags require no battery and are powered by the electromagnetic fields used to read them. Others use a local power source and emit radio waves (electromagnetic radiation at radio frequencies). The RFID tag may store, for example, numerical information for identifying the first toy part.

The first toy part may be paired, for example coupled to and physically in contact with a second toy part, for example the legs 230 of FIG. 2. The second toy part 330 includes an inductive element 325 for supplying power to the first toy part 310 and for receiving the RFID electromagnetic field from the RFID tag in the first toy part 310. When the first toy part 310 and the second toy part 320 are sufficiently proximate to one another or in contact with one another, the second toy part 320 inductively powers the first toy part 310 and the numerical information in the RFID tag of the first toy part is transmitted to the inductive element of the second toy part.

Each of the first toy part and the second toy part includes magnets for assisting in pairing of the parts. FIG. 3 illustrates each of the toy parts as including a pair of magnets, with the first toy part including magnets 353, 357, and the second toy part including magnets 351, 355. The pair of magnets in the first toy part are arranged about opposing sides of the inductive element 315, and are positioned in parallel but with opposite polarities. Similarly, the pair of magnets in the second toy part are arranged about opposing sides of the inductive element 325, and are positioned in parallel but with opposite polarities. In accordance with aspects of the invention, this arrangement reduces the amount of electromagnetic interference in, and thereby improves the efficiency of, the inductive coupling between inductive elements 315 and 325.

In the embodiment of FIG. 3, the second toy part includes a further inductive element 327 electrically coupled to the inductive element 325, although in some embodiments the coupling may be wireless. The further inductive element may be part of an RFID tag, and may be positioned for communication with a peripheral 330, which may be a peripheral RFID reader. In some embodiments, for example of a toy such as the toy of FIG. 2, the further inductive element 327 may be located in the base for the legs. The peripheral includes an inductive element 335, which may be used for inductive coupling with the further inductive element of the second toy part. As indicated in FIG. 3, the peripheral may also include an antenna for wireless communication with a computing device, although some embodiments the peripheral may use wired communications. In various embodiments the computing device may be, for example a computer, game console, or other computing device, which for example may provide for video game play.

Figure 4:
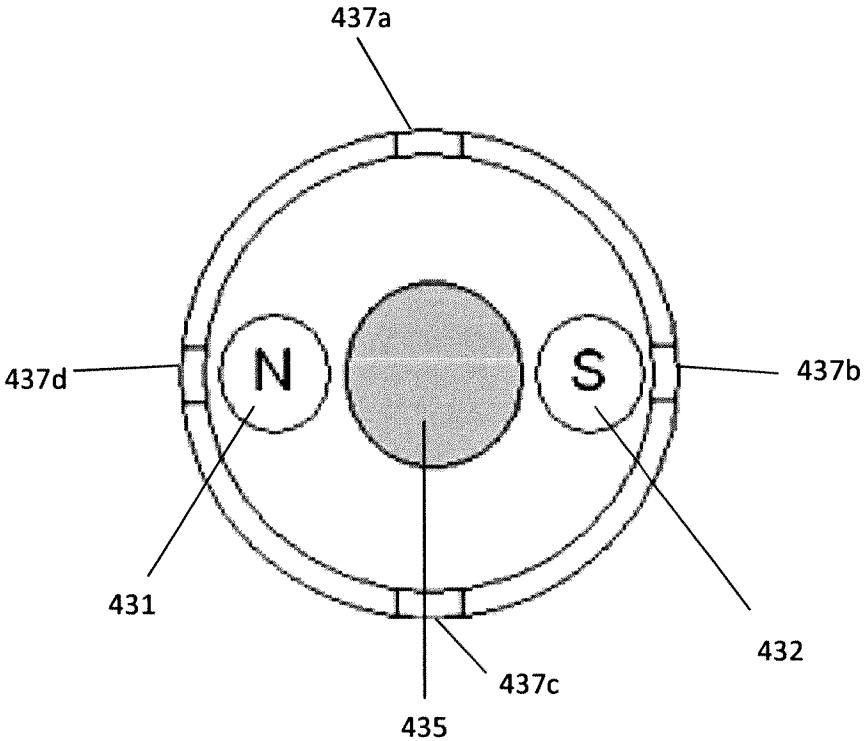
FIG. 4 illustrates an example of a toy part of a toy assembly in accordance with aspects of the present invention.

FIG. 4 depicts a simplified view towards a mating or pairing surface of one part of the toy assembly in accordance with aspects of the invention. For clarity, an inductive element and magnetic elements of the part of the toy assembly are shown in FIG. 4, although in many embodiments the inductive element and the magnetic elements would be shielded from view by a surface of the toy part. As shown in FIG. 4, the toy part is illustrated as being in cylindrical form, with the mating surface outlining a circular shape. The toy part in various embodiments may have varying forms and the mating surface may also outline various shapes. The toy part includes an inductive element 435, a first magnetic element 431 and second magnetic element 432. As illustrated in FIG. 4, the inductive element is centrally located about the mating surface. The magnetic elements are equally spaced about opposing sides of the inductive element, with the first magnetic element having a north pole towards the mating surface and the second magnetic element having a south pole towards the mating surface. In many embodiments, and as illustrated in FIG. 4, the size of the toy part, particularly about the mating surface, is so small that the magnetic elements may not be positioned at a great distance from the inductive elements. For example, in the embodiment of FIG. 4, a central axis of either magnet, for example defined by a line extending longitudinally through a center of the magnet from pole to pole, is closer to a sidewall of the toy part than to a center of the inductive element.

In addition, to assist in proper mating of the toy part with another toy part, the toy part includes guides 437*a-d* along an outer edge of the mating surface. The guides may be in the form of valleys (indentations) and ridges (bulges), with preferably some of the guides being valleys and some ridges, and configured for mating with a second toy part.

Figure 5:
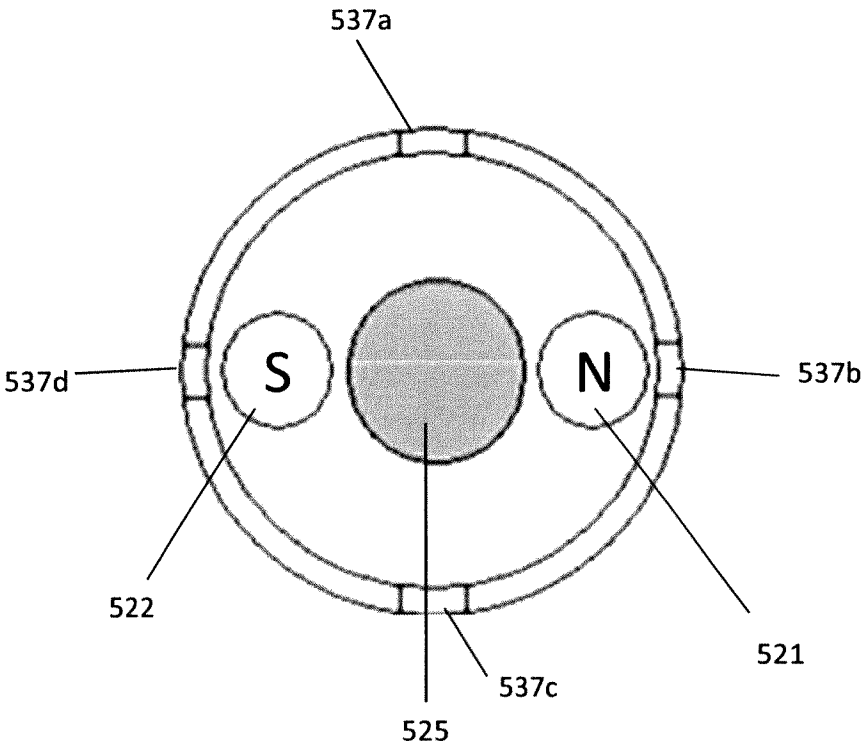
FIG. 5 illustrates an example of a toy part of a toy assembly in accordance with aspects of the present invention.

FIG. 5 depicts, in a manner similar to FIG. 4, a simplified view of a toy part intended to be paired with the toy part of FIG. 4. The surface of the toy part of FIG. 6 may be imagined as being "flipped over" so that the surface seen in FIG. 5 is placed atop the mating surface of the toy part of FIG. 4. As such, the toy part of FIG. 5, like the toy part of FIG. 4 includes an inductive element 525 and magnetic elements 521, 522. The inductive element and magnetic elements are arranged as in the embodiment of FIG. 4, with positions of the north and south poles of corresponding magnetic elements being reversed. Similarly, guides 537*a-d* of the toy part of FIG. 5 have a reverse configuration as compared to the guides of FIG. 4.

Figure 6:
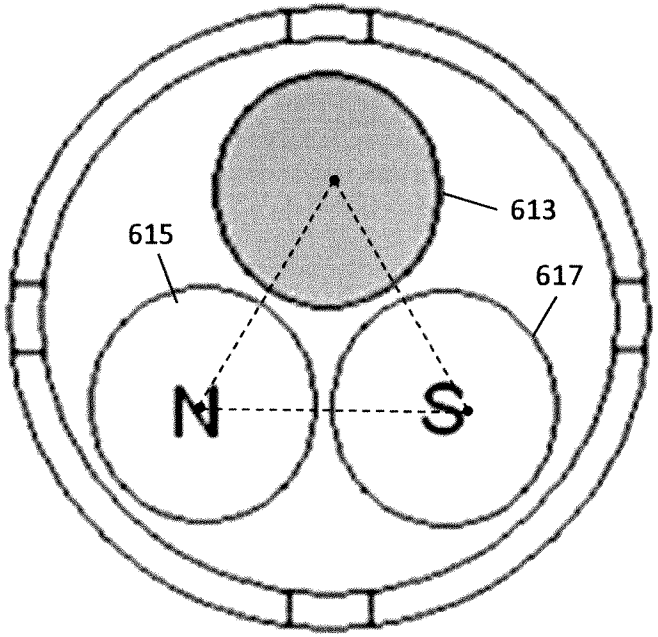
FIG. 6 illustrates an example of a toy part of a toy assembly in accordance with aspects of the present invention.
Figure 7:
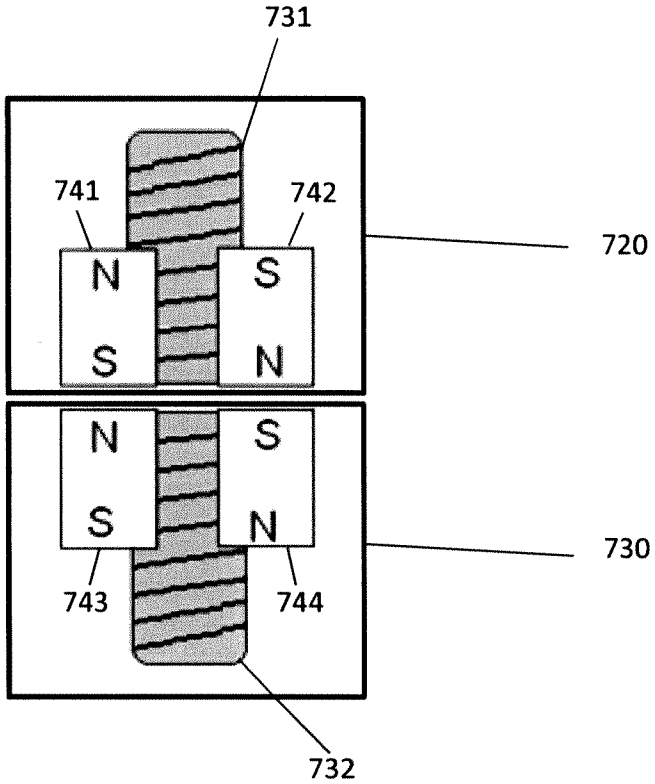
FIG. 7 illustrates an example of a toy assembly in accordance with aspects of the present invention.

The arrangement of the magnetic elements may vary and still be in accordance with aspects of the invention. FIG. 6 and FIG. 7 illustrate an alternative arrangement of magnetic elements and inductive elements wherein the magnetic elements and inductive elements in a particular device may be considered to form a triangular arrangement, for example. Depending on the shape of the device, such triangular arrangement may reduce space required for housing the magnetic and inductive elements, while still offering the benefits with respect to improved inductive coupling.

FIG. 6 may be considered to show a mating surface of a device, for example a toy part, along with relative positions of an inductive element 613 and magnetic elements 615, 617. The magnetic elements are arranged in parallel but with opposite polarities. In the embodiment of FIG. 6, each of central axis of the inductive element 613 and the magnetic elements may define vertices of a triangle. This triangular arrangement may require reduced cross-sectional space in the device, for example a toy part, compared to, for example, what may be considered the linear arrangement of magnetic elements and inductive elements of FIG. 4.

FIG. 7 illustrates an apparatus comprised of a first device 720 and a second device 730 each having inductive elements 731, and 732, respectively and magnetic elements 741, 742, and 743, 744, respectively, arranged as in the device of FIG. 6. As may be seen in FIG. 7, corresponding magnets of the devices have aligned magnetic dipole moments with the devices paired to form the assembly, and pairs of magnets in each device have anti-parallel magnetic dipole moments.

Although the invention has been discussed with respect to various embodiments, it should be recognized that the invention comprises the novel and non-obvious claims supported by this disclosure.

What is claimed is:

1. A toy including inductively coupleable parts, comprising:

a first part including a first inductive element, a first magnet, and a second magnet positioned proximate a first surface of the first device, the first magnet and the second magnet positioned so as to have anti-parallel magnetic dipole moments, the first inductive element having an inductance less than 100 micro-Henrys; and a second part including a second inductive element, a third magnet, and a fourth magnet positioned proximate a surface of the first device, the third magnet and the fourth magnet positioned so as to have anti-parallel magnetic dipole moments, the second inductive element having an inductance less than 100 micro-Henrys;

the first inductive element, the first magnet, and the second magnet having a relative spacing to one another that is the same as relative spacing of the second inductive element, the third magnet and the fourth magnet, with spacing between the first inductive element and either of the first magnet or the second magnet being less than 10 mm.

2. The toy of claim 1, wherein the first inductive element, the first magnet, and the second magnet are arranged linearly.

3. The toy of claim 1, wherein the first inductive element, the first magnet, and the second magnet define vertices of a triangle.

4. The toy of claim 1, wherein, magnetic dipole moments of the first magnet and the third magnet and magnetic dipole moments of the second magnet and the fourth magnet are aligned when the first part and the second part are paired for inductive coupling.

5. The toy of claim 1, wherein the first part further comprises a further inductive element, the further inductive element positioned proximate another surface of the first device.

6. The toy of claim 5, wherein the further inductive element is within a base of the first device.

7. The toy of claim 5, wherein the other surface is on an opposite side of the first device than the first surface.

* * * * *